United States Patent [19]

McIntyre

[11] 4,154,136

[45] May 15, 1979

[54] DRUM PITCH CONTROL ASSEMBLY

[76] Inventor: Rodney A. McIntyre, Box 25, Albert City, Iowa 50510

[21] Appl. No.: 881,903

[22] Filed: Feb. 27, 1978

[51] Int. Cl.[2] ..... G10D 13/02

[52] U.S. Cl. ..... 84/411 A

[58] Field of Search ..... 84/411–420

[56] References Cited

U.S. PATENT DOCUMENTS

| | | | |
|---|---|---|---|
| 1284526 | 11/1918 | Winne | 84/411 A |
| 2,061,244 | 11/1936 | Au-Miller | 84/411 A |
| 3,439,573 | 4/1969 | Zottolo | 84/411 A |

FOREIGN PATENT DOCUMENTS

| | | | |
|---|---|---|---|
| 79778 | 2/1895 | Fed. Rep. of Germany | 84/411 A |
| 697976 | 9/1940 | Fed. Rep. of Germany | 84/411 A |

*Primary Examiner*—Lawrence R. Franklin

*Attorney, Agent, or Firm*—Rudolph L. Lowell

[57] ABSTRACT

A pitch control assembly for adjusting the tension on a drum head of a musical drum having a cylindrical body portion with an open end covered by the drum head, a flesh hoop attached to the periphery of the drum head, and a tension band for engaging the flesh hoop to apply tension on the drum head. The control assembly includes a rotatable tension adjusting ring encircling the drum body portion and having a plurality of circumferentially spaced apart slots inclined to the plane of the drum head, a plurality of abutments on the drum body portion to hold the adjusting ring against movement toward the drum head, connecting links that connect the tension band with follower members arranged in contact engagement with sidewalls of the slots in the adjusting ring, and an adjustable mechanism connected to the adjusting ring and the drum body portion for rotatably adjusting the ring relative to the drum body portion.

4 Claims, 7 Drawing Figures

DRUM PITCH CONTROL ASSEMBLY

BACKGROUND OF THE INVENTION

1. Field of the Invention

The present invention relates in general to a pitch control assembly for a musical drum, and more specifically to such assemblies that are disposed on the exterior of the drums on which they are employed.

2. Description of the Prior Art

Adjusting the tension of a drum head to vary the pitch of a standard drum has long been a tedious and inconvenient task that involves a separate adjustment of a plurality of adjustable units connected between a drumhead tension band and the body portion of the drum. In the past, various drum constructions have been proposed to make such adjustment easier. For example, U.S. Pat. Nos. 2,051,671 and 2,061,244, to Au-Miller disclose relatively elaborate arrangements that are disposed inside a drum for achieving pitch adjustment by manipulation of a single adjusting mechanism and patents to Hull and Newberry, U.S. Pat. Nos. 2,550,249, and 1,901,765 and 2,115,741, respectively, disclose the use of rotatable rings that provide a cam action to vary drum head tension.

The present invention provides a pitch control assembly that operates on a cam action principle and in that respect falls in the same general class as that of the Newberry and Hull inventions. However, the structure of the present invention is entirely different from that disclosed by Newberry and Hull so as to provide a pitch control assembly that is simple to manipulate and efficient in operation to easily and quickly effect precise tension adjustments.

SUMMARY OF THE INVENTION

The present invention provides a pitch control assembly for a musical drum that includes an open ended cylindrical body portion, a drum head covering one of the open ends of said body portion and connected at its periphery to a flesh hoop, and a drum head tension band for engaging the flesh hoop. The control assembly includes a rotatable tension adjusting ring encircling the drum body portion and having a plurality of circumferentially spaced apart cam surfaces, means for limiting movement of the adjusting ring toward the drum head, a plurality of means connecting the tension band to the adjusting ring, each of which has a portion in coacting engagement with an associated cam surface of the adjusting ring, and adjusting means connected to the adjusting ring and the drum body portion for adjustably rotating the adjusting ring.

In a preferred embodiment of the present invention, the movement limiting means consists of a plurality of abutment means mounted circumferentially about the exterior of said drum body portion for engagement with a lateral annular flange on the adjusting ring. The connecting means of the preferred embodiment is formed of a plurality of adjustable members connected to the tension ring and having vertically moveable follower members engageable with the cam surfaces of the adjusting ring. As the adjusting ring is rotated about its axis the follower members are moved by the cam surfaces, thereby to control adjustment of the drum head tension.

DESCRIPTION OF THE PREFERRED EMBODIMENT

Figure 1:
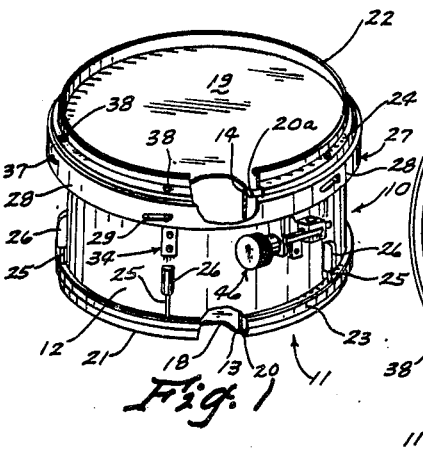
FIG. 1 is a perspective view of a drum having the pitch control assembly of the present invention in assembly relation therewith.

The present invention is adapted to serve as a pitch control assembly for a musical drum and is indicated generally at 10 in FIG. 1 in association with a drum 11.

The drum 11 includes a cylindrical body portion 12 that is open at its opposite ends 13 and 14. Drum heads 18 and 19 cover each of the open ends 13 and 14, respectively, and are attached at their peripheries to flesh hoops 20 and **20*a*, also respectively, that fit snugly about the drum body portion ends 13 and 14. Tension bands 21 and 22, having outwardly projecting annular flange portions 23 and 24, respectively, for engaging the peripheries of the flesh hoops 20 and 20*a*, are connected to the body portion 12 to apply an axially directed pressure on the flesh hoops 20 and 20*a*, whereby to place the drum heads 18 and 19** under tension.

The tension band 21 is connected in a usual manner to the drum body portion 12 by means of a plurality of circumferentially spaced bolts 25 extended through the flange 23 for threaded engagement with associated lugs 26 fixed about the drum body portion 12. Tension of the drum head 18 can, thus be varied by individually adjusting the bolts 25.

Figure 2:
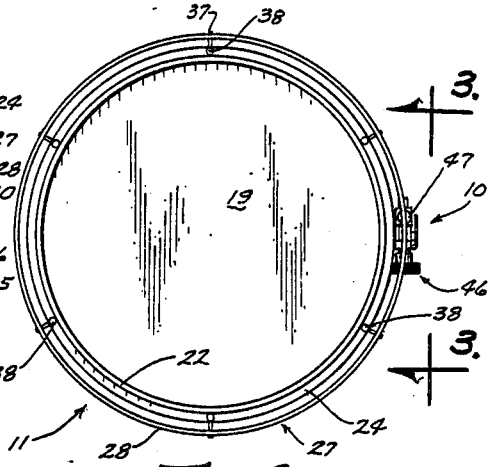
FIG. 2 is a plan view of the drum of FIG. 1.

The tension band 22 is connected to the drum body portion 12 by means including the pitch control assembly 10 in a manner to eliminate the necessity of individual adjustment of a plurality of bolts when a tension change in the drum head 19 is desired. The pitch control assembly 10 includes a tension adjusting ring 27 (FIG. 2) arranged in a concentrically spaced relation about the drum body portion 12, and formed from a lightweight, high strength metal. The ring 27 includes a band portion 28 formed with a plurality of circumferentially spaced slots 29 (FIGS. 1 and 3) which are inclined relative to the plane of the drumhead 19. The band portion 28 has an inwardly projected annular flange 30 (FIG. 4) on the side thereof remote from the drum head 19.

Figure 3:
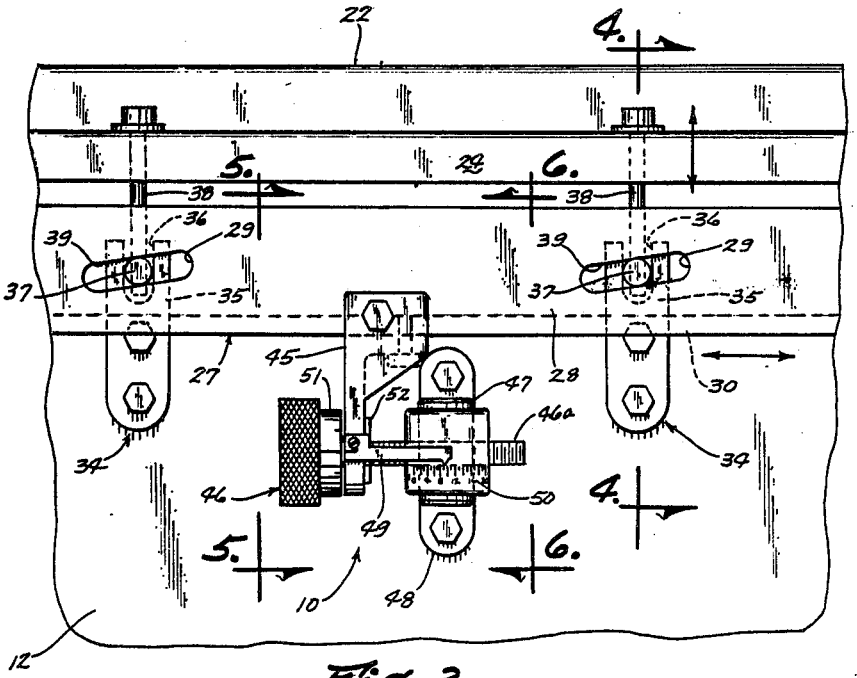
FIG. 3 is an enlarged detail side view as seen along line 3—3 in FIG. 2.
Figure 4:
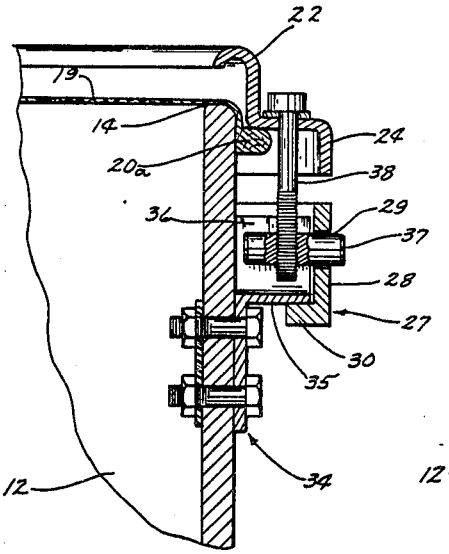
FIG. 4 is a sectional view taken on line 4—4 of FIG. 3.

To prevent movement of the tension adjusting ring 27 toward the drum head 19, a plurality of combination abutment and guide members 34 (FIG. 3) are circumferentially spaced about and are bolted to the exterior of the drum body portion 12 equi-distant from the drum head 19. Each combination member 34 has a U-shaped head portion 35 to form a guideway 36 that is open in a direction toward the drum head 19. Referring to FIG. 4, it is seen that the head portions 35 are positioned between the drum body portion 12 and the band portion 28 of the tension adjusting ring 27 for abutting engagement with the flange 30 and contact engagement with the inside diameter of the band portion 28. Accordingly, the head portions 35 abut against the ring band portion 28 and the ring flange 30 to position the band portion 28 whereby to concurrently maintain the tension adjusting ring 27 against movement toward the drum head 19 and concentrically spaced about the drum body portion 12.

Each guideway 36 of the combination member 34 guidably receives a cylindrical elongated nut 37 threaded on a bolt 38 disposed through the annular flange member portion 24 on the tension band 22. As indicated in FIG. 3, the width of each of the guideways 36 is slightly larger than the diameter of one of the nut members 37 whereby to guidably support vertical movement of the nut members 37. One end of each of the cylindrical nut members 37 projects into one of the slots 29 of the tension adjusting ring 27 for bearing engagement with the upper sidewall 39 of an associated ring slot 29, thereby limiting movement of the ring 27 away from the drumhead 19. A nut member 37 thus functions as a cam follower member relative to the slot upper sidewall 39 which constitutes a cam section. Although the tension adjusting ring 27 is held against axial movement by the abutment of the combination members 34 and the connecting means comprised of the bolts 38 and the cylindrical nut member 37, it is permitted to rotate about its axis. Although the slots 29 are preferably cut entirely through the band portion 28 of the ring 27, such construction is not essential to the present invention and all that is necessary is that the ring 27 must have inclined protrusions or indentations that provide a surface similar to the sidewall peripheries 39 of the slots 29.

Figure 5:
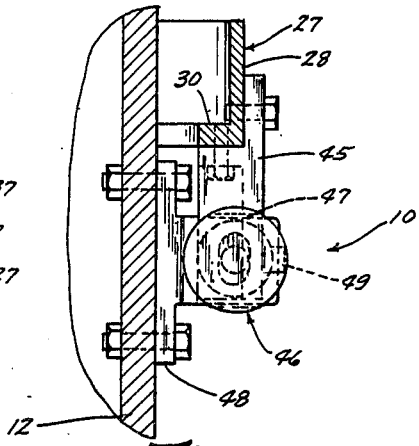
FIG. 5 is a sectional view taken on line 5—5 of FIG. 3.
Figure 6:
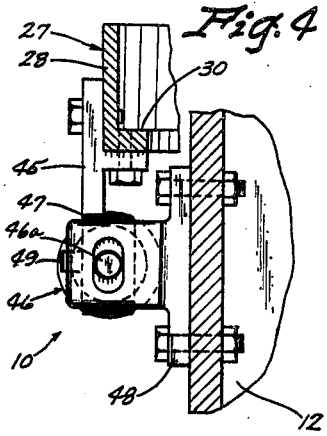
FIG. 6 is a sectional view on line 6—6 of FIG. 3.
Figure 7:
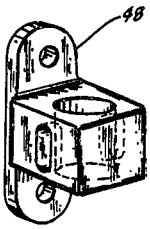
FIG. 7 is an enlarged perspective view of a journal member included in the pitch control assembly of FIG. 1.

To adjust the rotational movement of the tension adjusting ring 27, there is provided an adjusting mechanism which includes a bracket 45 (FIGS. 3 and 5) secured to and suspended from the ring flange 28 and rotatably supporting an adjusting screw having a knurled central knob 46 and a threaded shaft **46*a*. The shaft 46*a* is in threaded engagement with a barrel nut 47 that is held in place by a journal member 48 (FIG. 7) bolted to the drum body portion 12. The shaft 46*a* has fixed thereto collars 51 and 52 on each side of the bracket 45, so that as the shaft 46*a* is threaded into or out of the barrel nut 47, the adjusting ring 27 is rotated respectively to the right or left about the longitudinal axis of the drum body portion 12 to produce relative movement of the nut members 37 in the slots 29. The peripheries 39 of the slots 29 are cam surfaces that coact with the nut members 37, which serve as follower members. Due to the inclined alignment of the slots 29, rotational movement of the ring 27 to the left will drive the nut members 37 downwardly thereby increasing tension on the drum head 19**, whereas rotational ring movement to the right will have the opposite effect.

To provide a visual indication of the tension setting of the drum head a marker 49 attached to the bracket 45 is arranged to overlie a scale 50 on the journal member 48. Thus, by simply manipulating the adjusting screw by the single control knob the control assembly of the present invention provides for a rapid, and precise adjustment of the drum head tension.

Although a single tension control assembly 10 for adjusting the drumhead 19 has been described, it is apparent that a similar second control assembly may be provided for drum head 18. Generally, however, it is only necessary to control the pitch of the drum head played upon.

Although the invention has been described with respect to a preferred embodiment thereof, it is to be understood that it is not to be so limited since changes and modifications can be made therein which are within the full intended scope of this invention as defined by the appended claims.

I claim:

1. A pitch control assembly for a musical drum having a tubular cylindrical body portion with open ends, a drum head covering at least one of said open ends and having a peripheral portion connected to a flesh hoop extended about said body portion, and an annular drum head tension band engageable with said flesh hoop to apply a tension on said drum head, said pitch control assembly comprising:

(a) a rotatable tension adjusting ring positioned about the body portion of said drum and formed with a plurality of circumferentially spaced cam surfaces inclined at an angle to the plane of said drum head;

(b) means for limiting axial movement of said adjusting ring toward said drum head;

(c) a plurality of means connecting said tension band with said adjusting ring, each of said connecting means having an extension member connected with said tension band and a cam follower portion adjustably disposed on said extension member and in coacting engagement with an associated cam surface of said adjusting ring; and (d) adjustable means connected to said adjusting ring and said drum body portion for adjustably rotating said ring about the longitudinal axis of said body portion to move said cam surface relative to said cam follower to vary the tension on said drum head.

2. A pitch control assembly according to Claim 1 wherein:

(a) said movement limiting means is a plurality of abutment guide means mounted circumferentially about the exterior of said drum body portion and a flange on said adjusting ring that engages said abutment means.

3. A pitch control assembly according to claim 2, wherein:

(a) each of said abutment guide means includes a guideway for guidably supporting one of said follower members for vertical movement in response to rotation of said adjusting ring.

4. A pitch control assembly for a musical drum having a cylindrical body portion with opposite open ends, a drum head covering at least one of said open ends and having a peripheral portion connected to a flesh hoop extended about said body portion, and an annular drum head tension band engageable with said flesh hoop to apply a tension on said drum head, said pitch control assembly comprising:

(a) a plurality of abutment guide means mounted circumferentially about the exterior of said body portion and uniformly spaced from said drum head;

(b) a rotatable tension adjusting ring having a flange that engages said abutment means and is limited thereby from moving toward said drum head, said adjusting ring including a plurality of circumferentially spaced apart slots directed on an incline to the plane of said drum head;

(c) a plurality of means connecting between said tension band and said adjusting ring, each of said means having an extension member connected with said tension band and a cam follower portion adjustably disposed on said extension member and in coacting engagement with an associated slot in said adjusting ring; and (d) adjustable means connected to said adjusting ring and said drum body portion for adjustably rotating said ring about the longitudinal axis of said body portion to vary the tension on said drum head.

* * * * *